US005584307A

United States Patent [19]

Bauer et al.

[11] Patent Number: 5,584,307

[45] Date of Patent: Dec. 17, 1996

[54] ASSEMBLY INTENDED FOR OPERATING ON HAIR USING VAPOUR

[75] Inventors: Daniel Bauer, Le Raincy; Mary-France Foucault, Issy Les Moulineaux; Dominique Esclar, Herpy L'Arlesienne; Régis Beitone, Paris, all of France

[73] Assignee: L'Oreal, Paris, France

[21] Appl. No.: 361,531

[22] Filed: Dec. 22, 1994

[30] Foreign Application Priority Data

Dec. 22, 1993 [FR] France ..... 93 15436

[51] Int. Cl.[6] ..... A45D 24/22

[52] U.S. Cl. ..... 132/113; 132/112; 132/227; 132/228; 132/271; 132/272

[58] Field of Search ..... 132/112, 113, 132/111, 228, 238, 244, 263, 271, 272, 227; 34/97, 98, 101; 219/222

[56] References Cited

U.S. PATENT DOCUMENTS

| | | | |
|---|---|---|---|
| 1,504,567 | 8/1924 | MacDonald et al. . | |
| 1,798,760 | 3/1931 | Rothman | 219/222 |
| 2,171,725 | 9/1939 | Hambrick, Jr. | 132/113 |
| 2,880,299 | 3/1959 | Jones | 132/272 |
| 3,019,795 | 2/1962 | Weatherholt et al. | 132/271 |
| 4,166,473 | 9/1979 | Bauer et al. . | |
| 4,341,229 | 7/1982 | Bauer et al. . | |
| 4,533,819 | 8/1985 | Valiulis | 219/225 |
| 4,936,027 | 6/1990 | Tsuji | 132/228 |
| 5,195,545 | 3/1993 | Thibodeaux | 132/112 |

FOREIGN PATENT DOCUMENTS

| | | |
|---|---|---|
| 2273492 | 2/1976 | France . |
| 2658049 | 8/1991 | France . |
| 167656 | 6/1934 | Sweden . |
| 2082058 | 3/1982 | United Kingdom . |

*Primary Examiner*—Gene Mancene
*Assistant Examiner*—Pedro Philogene
*Attorney, Agent, or Firm*—Young & Thompson

[57] ABSTRACT

Assembly intended for operating on hair, including a generator, a tool holder (30) equipped with a grip for holding, and a tool (2, 20), the generator and the tool holder (30) being arranged to provide the tool (2, 20) mounted on the tool holder (30) with at least one vapour supply, the generator and the tool holder (30) being distant from one another and connected by a flexible bundle including at least one pipe for supplying the tool holder (30) with vapour; the tool holder (30) supports a vapour-outlet line (54), the wall of which has vapour-distribution orifices (58) passing through it.

24 Claims, 7 Drawing Sheets

ASSEMBLY INTENDED FOR OPERATING ON HAIR USING VAPOUR

FIELD OF THE INVENTION

The present invention relates to an assembly intended for operating on hair, the assembly including a generator, a tool holder equipped with a grip for holding, and a tool, the generator and the tool holder being arranged to format least one vapour supply for the tool.

Such an assembly, intended for professional hair stylists or for users, allows the hair to be styled or to be given a particular treatment.

BACKGROUND OF THE INVENTION

It is known that by subjecting a lock of hair to the action of water vapour superheated to a temperature of between 100° and 150° C. for a few seconds, the operation on the hair is considerably improved, such as, for example, the operation of setting: in this case in particular, the set holds better, the hair treated is softer, more shiny; such a method is described in FR-A-2,273,492; this document also indicates that the water vapour may be combined with other fluids such as reducing gases, oxidizers in order, for example, to bring about permanent deformation of the hair. Regardless of the treatment, it has been observed that treating hair using vapour has the great advantage of treating the hair within the mass of the hairs, and not at their surface and makes it possible to obtain results which are superior in terms of intensity, faster, and which leave the surface of the hair in a better condition.

Until now, operating on hair using vapour has been carried out with the aid of appliances, like those described in FR-A-2,273,492, already mentioned, which comprise a tool holder equipped with a grip for holding, into which the vapour generator is incorporated, and capable of being inserted into a roller which has already been positioned in the hair; in some other appliances, like the one described in U.S. Pat. No. 4,121,602, the tool, such as a comb, is also incorporated into the tool holder, this device being designed, however, for applying treatment products in the hot state, via thick liquids.

The appliances hereinabove of the prior art have drawbacks: they are necessarily heavy and voluminous, and therefore not very easy to use, and are often noisy and therefore detract from the comfort of the person whose hair is being operated on.

It has already been proposed, especially in CH-A-167, 656, to arrange the generator and the tool holder to be distant from one another and to connect them using a flexible tubing including at least one pipe for supplying the tool holder with vapour.

By virtue of this arrangement, according to which the generator may furthermore be housed in a casing configured as a trailing device which can be placed on the ground, the drawbacks mentioned hereinabove are eliminated; however, an assembly according to this document, apart from being complicated, does not allow good distribution of vapour through the tool, regardless of the nature of the latter, the vapour leaving the tool holder directly into the tool in the direction of the longitudinal axis of the tool holder.

The object of the present invention is to overcome these drawbacks.

SUMMARY OF THE INVENTION

According to the present invention, an assembly intended for operating on hair, including a generator, a tool holder equipped with a grip for holding, and a tool, the generator and the tool holder being arranged to provide the tool with at least one vapour supply, the generator and the tool holder being distant from one another and connected by a flexible tubing including at least one pipe for supplying the tool holder with vapour, is characterized in that the tool holder supports a vapour-outlet line, the wall of which has vapour-distribution orifices passing through it.

The tool may be mounted permanently on the tool holder or in a way such that it can be removed. Such an assembly further has the advantage of avoiding waiting for the assembly to get up to temperature because, in the assembly according to the invention, the generator can remain operational and this corresponds to a saving in time for the user; when several different tools are associated with the tool holder, there being a single generator, not only is a certain economy obtained but also such an arrangement leads to more flexible use of the assembly and greater safety owing to the fact that as the tools have to be cleaned after each operation, it is possible to do this in complete safety, the removed tool then being electrically isolated.

It will be understood that the vapour provided by the generator may be any sort of vapour necessary for operating on hair, such as water vapour, alcohol vapour or some other vapour; of course, while this is being transferred from the generator to the hair the vapour can change enormously; also, here vapour is understood to be the state in which the fluid reaches the hair; this is, in general, a gaseous mixture at a pressure close to atmospheric pressure, of the order of 1 to 1.5 atmospheres, and at a temperature of above 75° C., without an upper limit, but preferably lying between 85° C. and 120° C.; this gaseous mixture contains a minimum of water vapour, this minimum being 37% by volume related to the total volume of the gaseous mixture; apart from this water vapour and the fluid necessary for operating on the hair, this gaseous mixture may contain other gases such as air, oxygen, nitrogen, a rare gas, ethyl alcohol, hydrogen peroxide or the like; it should also be noted that owing to the condensation phenomenon, this gaseous mixture may also contain, when it reaches the hair, a certain proportion of liquid such as water or solvent.

As the volume of the casing which carries the generator is not necessarily limited, other means may be provided for conveying other fluids through the tool such as aerosols or the like such as air, it being possible for these fluids possibly to be heated there; the air may be blown or sucked through the tool, it being possible for the blowing or suction means to be associated with the tool holder or placed in the casing, which can equally well receive electrical, electromechanical or electronic means intended for the management and operation of the assembly.

Advantageously, the tool holder supports a line for conveying air through the tool; the line for conveying air through the tool is connected to the suction side of a suction turbine mounted in the tool holder; the tool holder has a thermophor element; the tool holder supports a line for conveying another fluid through the tool; the tool holder includes an electrical heating resistor.

The tool is preferably equipped with a diffuser.

Advantageously, the diffuser is arranged such that the vapour is distributed homogeneously regardless of the extent to which the bit of hair being treated covers the diffuser.

According to one embodiment, the tool is in the general shape of tongs and includes a lever consisting of a plate covering the working surface of the tool, the plate including passages for the vapour.

Advantageously, the tool is a double-function tool and includes two working faces; as a variant, the tool is a double-function tool and includes just one working face. The working face of the tool may be a well-defined surface of the flat, cylindrical, conical or some other sort, or configured as a brush or a comb.

According to another variant, the tool includes a thermally conductive mass; the tool holder includes a heating element for heating the thermally conductive mass of the tool.

According to another embodiment, the tool is a double-function tool and has the shape of tongs including two jaws, each of which has a working face.

The tool may be secured to the tool holder and stationary relative to the tool holder; or the tool may be secured to the tool holder and mounted so that it can turn relative to the tool holder.

As a variant according to an advantageous arrangement, the tool is mounted on the tool holder in such a way that it can be removed.

BRIEF DESCRIPTION OF THE DRAWINGS

To make the subject of the invention easier to understand, there will now be described, purely by way of non-limiting illustration, some embodiments which are represented in the appended drawings.

In these drawings.

DESCRIPTION OF THE PREFERRED EMBODIMENTS

Figure 1:
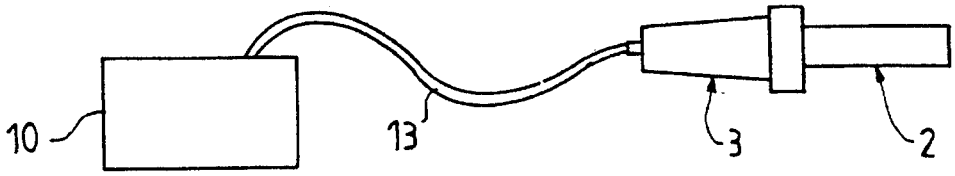
FIG. 1 diagrammatically represents an assembly according to the invention, the tool being mounted permanently on the tool holder.

Referring to FIG. 1, a treatment assembly for hair includes a generator 10 which is connected by a flexible tubing 13 to a tool holder 3 carrying a tool 2; the tool 2 is mounted permanently on the tool holder 3.

Figure 2:
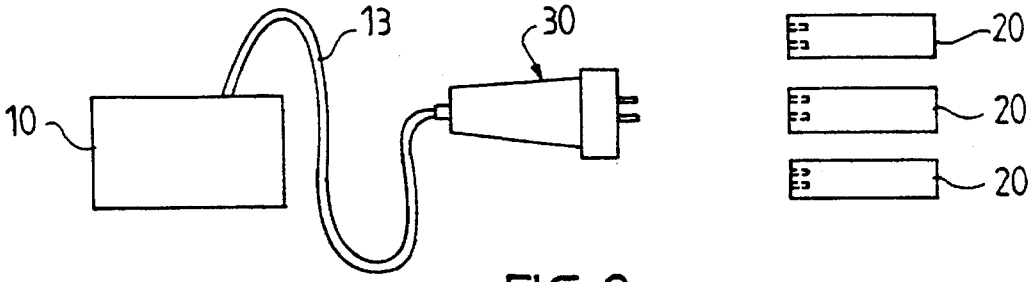
FIG. 2 diagrammatically represents an assembly according to the invention, the tool being removable.
Figure 3:
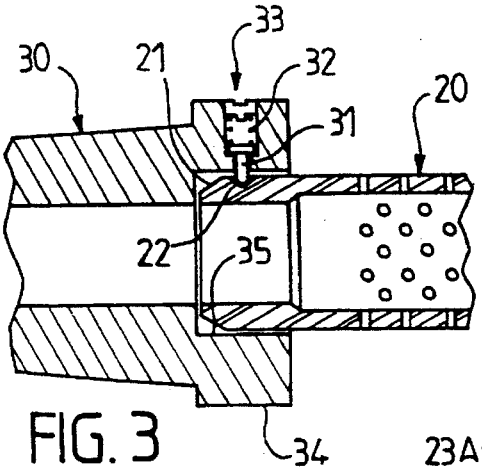
FIG. 3 is a partial view in section showing the mounting of a removable tool on the tool holder.

The diagram represented in FIG. 2 shows a treatment assembly in which various removable tools 20, just three being represented in the drawing, can be mounted without preference on the tool holder 30. In this case, means 33 for mounting a removable tool 20 are provided, as the partial section in FIG. 3 shows; according to this FIG. 3, the mounting means 33 consist, for example, of a pin 31 arranged radially in the tool holder 30; the tool holder 30 at its end 34 has a cavity 35 in which the end of the tool 20 engages; at right angles with this cavity 35 the pin 31, subjected to the elastic action of a spring 32, extends into the cavity 35; the tool 20 has a housing 22 at its periphery intended to receive the pin 31, the end of the tool 20 being frustoconical at 21 to facilitate the retraction of the pin 31 as the tool 20 is being inserted into the cavity 35 as far as the position in which the pin 31 interacts with the housing 22; in this embodiment, the tool 20 while being removable is stationary relative to the tool holder 30 when it is mounted in the cavity 35.

Figure 4A:
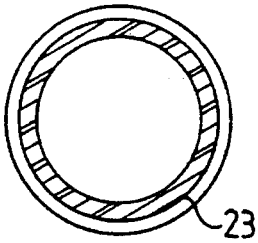
FIG. 4A is a section on IVA—IVA of FIG. 4.
Figure 4B:
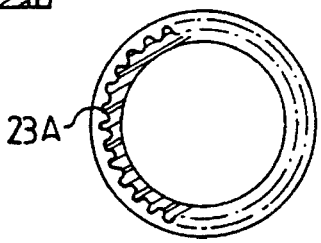
FIGS. 4B and 4C are similar to FIG. 4A but each relate to a variant.
Figure 4C:
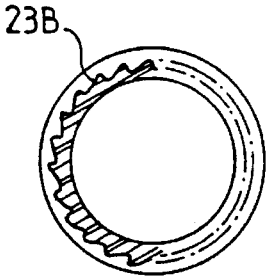
Figure 4:
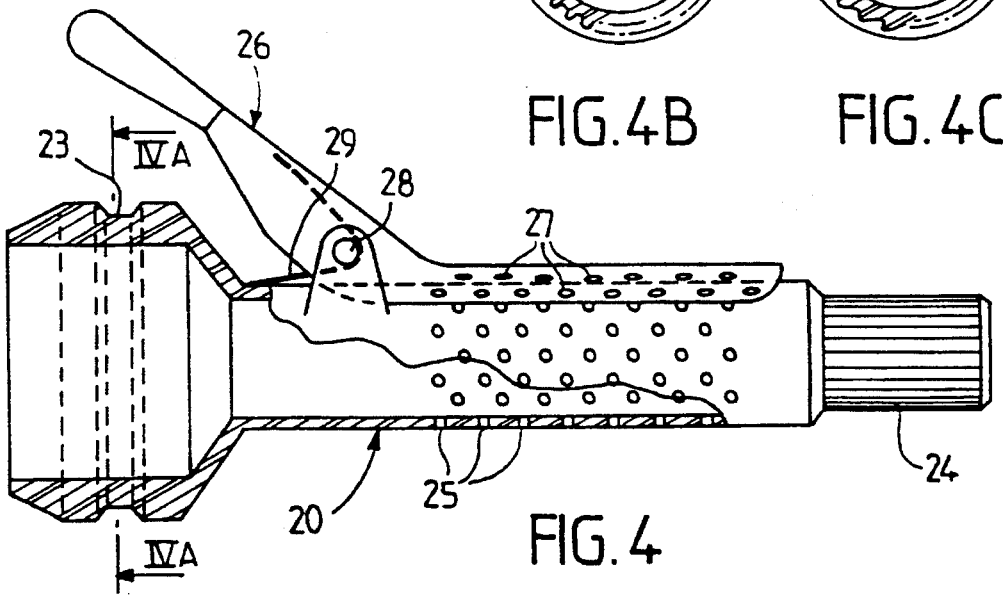
FIG. 4 shows, partially in section, a tool mounted on the tool holder so that it can turn.

As will be described in more detail below, the removable tool 20 may be mounted on the tool holder 30 while being capable of turning relative to the latter; to do this, the housing 22 is replaced by a groove 23 formed at the end of the tool 20 and designed to be cylindrical with a circular section, as can be seen in FIG. 4. The bottom of the groove 23 with which the pin 31 of the tool holder 30 interacts may be uniform as FIG. 4A shows; although the bottom of the groove is uniform a certain amount of clamping may be provided in order to hold the tool using friction; it is equally possible to not provide any groove and simply to fit the end of the tool into the tool holder with a sufficiently small amount of clearance to ensure it is held by friction; this friction may be obtained in other ways; thus, for example, in the case where the tool has a groove 23, as a variant, the bottom of the groove 23 may be equipped with striations in order to brake the rotation of the tool; these striations may be axial and symmetrical, like the striations 23A in FIG. 4B, or axial and asymmetric like the striations 23B in FIG. 4C; when the striations are symmetrical, the braking of the tool in terms of rotation is independent of its direction of rotation; when the striations are asymmetric, they are produced so that braking is greater in the direction of unrolling the hair from around the tool 20 than the braking in the direction of winding up the hair, this being in order to facilitate the work of the operator. Advantageously, for the purpose of using the tool 20 for rotating it, the tool 20 has an end 24, opposite the one which has the groove 23, arranged in the form of a cylindrical portion with a striated external surface making it easier to hold it. Indeed, the tool 20 represented in FIG. 4 is a roller for styling hair and making it possible to give it soft curls, by setting, or to give it tight curls, by giving a permanent set; the hollow tool has a cylindrical wall pierced with holes 25 for the passage of the vapour pushed through the tool under the conditions described hereinbelow; to facilitate the operation, the hair is held by tongs including a lever 26 articulated about a spindle 28, of which a part equipped with holes 27 matches the shape of the perforated cylindrical wall towards which it is urged by a hairpin-shaped spring 29.

Figure 32:
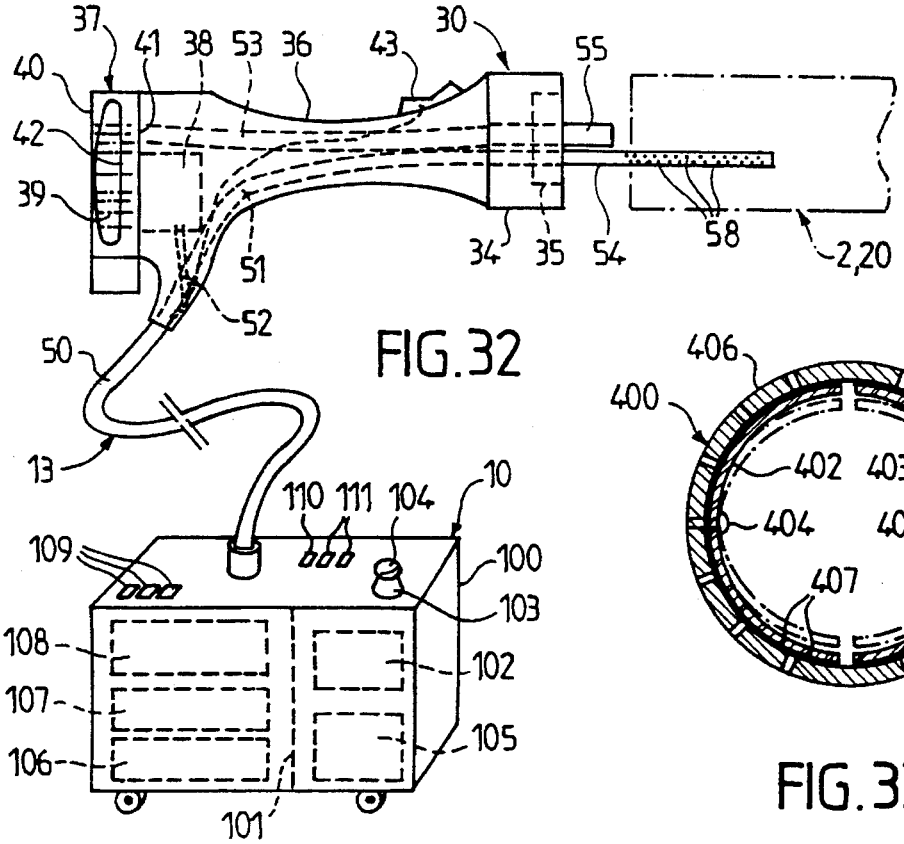
FIG. 32 diagrammatically shows the assembly consisting of a generator and of a tool holder connected to the generator, the tool holder being designed to receive a series of removable tools.

As shown diagrammatically in FIG. 32, a generator 10 may consist of a casing 100 divided into two main compartments separated by a partition 101; one compartment receives at least one reservoir 102 for the liquid to be vaporized which can be introduced therein via a mouth 103 accessible from outside the casing 100 and closed by a stopper 104; this same compartment also receives electrical heating means or vapour-generating means 105 for converting the liquid contained in the reservoir 102 into vapour; the other compartment of the casing 100 comprises electrical means 106, electromechanical means 107, electronic means 108; the electrical means 106 are, for example, a voltage transformer for a low-voltage electrical supply, such as 12 volts, for the assembly; the electromechanical means 107 are, for example, solenoid valves; the electronic means 108 are, for example, a microprocessor for managing the operations of operating the assembly, in particular including the management of operating sequences bearing in mind the type of tool associated, as described hereinbelow: various programmes of sequences may be selected with the aid of push-buttons 109 arranged on the top wall of the frame 100 which also has a stop-start switch 110 and indicators 111 indicating, for example, the pressure and temperature prevailing in the reservoir 102.

The tool holder 30 is connected to the generator 10 by a tubing 13; the tubing 13 consists of a flexible sheath 50 made of a thermally insulating material, through which at least one pipe 51 for the passage of the vapour from the generator 10 towards the tool holder 30, and electrical conductors represented diagrammatically at 52 pass; the tool holder 30 supports a vapour-outlet line 54, consisting of a tube, one end of which is connected to the flexible pipe 51, the other end of which is closed and of which the wall situated outside the tool holder 30 has orifices 58 passing through it for a distribution of the vapour in radial directions relative to the "vapour" line 54, towards the tool 2, 20 carried by the tool holder 30.

Figure 5:
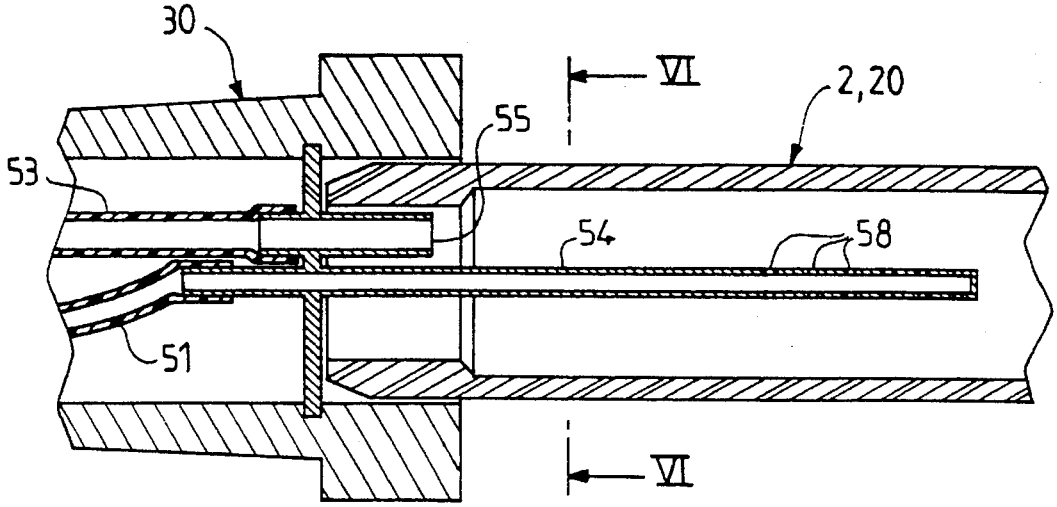
FIG. 5 is a view, in partial section, of a tool holder according to the invention, equipped with a tool.

The tool holder 30, in the example shown in FIG. 32, at its end opposite the one intended to receive the tool 2, 20, has a motorized fan device 37 especially comprising an electric motor 38 for driving a fan 39 contained within a collar 40 having two openings 41, 42; depending on the direction of rotation of the motor 38, air enters via one of the openings 41, or 42, and is driven through the other opening 42, or 41 by the motorized fan 37; preferably, the fan of the motorized fan 37 is designed in the form of a suction turbine; the tool holder 30 supports a line 55 for the air forced by the motorized fan 37; the "air" line 55 is in communication with the opening 41 via a pipe 53 and extends parallel to the "vapour" line 54; it is shorter than the "vapour" line 54 and can come out of the tool holder 30 slightly as shown in FIG. 32, or not extend beyond the tool holder 30, as shown in the partial section of FIG. 5 in which the means for linking the tool 2, 20 with the tool holder 30 have deliberately not been represented, it being possible for the tool 2, 20 to be mounted in a stationary manner (2) on the tool holder 30, or in a way so that it can move, in rotation, or in a way such that it can be removed (20) as explained hereinabove. As can be seen in FIG. 32, at the upper part of its central part 36 configured as a grip for holding, the tool holder 30 has a switch 43 electrically connected like the motorized fan group 37 to the "electric" compartment of the generator 10 via the electrical conductors represented diagrammatically as 52; the switch 43 has several positions and allows not only the start-up of the sequence of the programme chosen by the push buttons 109 but also brings the motorized fan 37 into operation in one direction or the other in order to blow or suck air through the "air" line 55 depending on the tool chosen and on the task chosen.

The tool holder 30 may equally well have a thermophor element which allows the tool to be kept at the appropriate temperature for the operation, which it allows. The thermophor element may simply consist of a thermal metal mass brought up to temperature by the passage of vapour through the "vapour" line 54 close to it; it may equally well itself be a heat generator if it includes, for example, an electrical resistor.

The tool holder 30 may equally well have other supply pipe for a specific gaseous fluid or aerosol from the generator 10.

Figure 6:
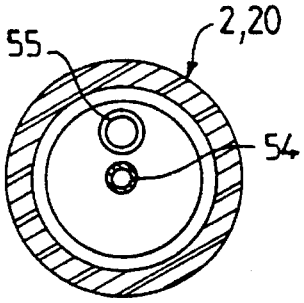
FIG. 6 is a section on VI—VI of FIG. 5.
Figure 7A:
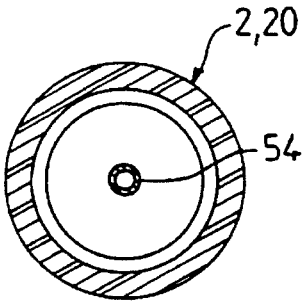
FIGS. 7A to 7D are similar to FIG. 6 and show various configurations of the tool holder.
Figure 7B:
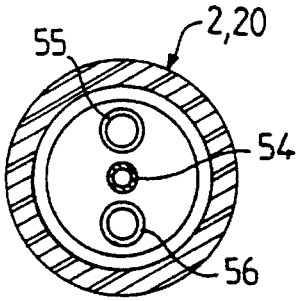
Figure 7C:
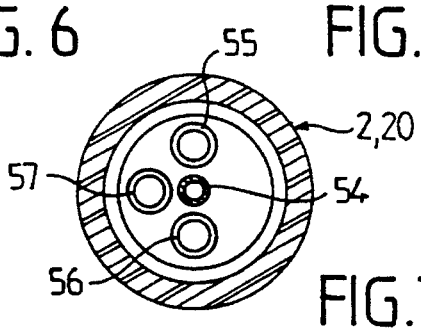
Figure 7D:
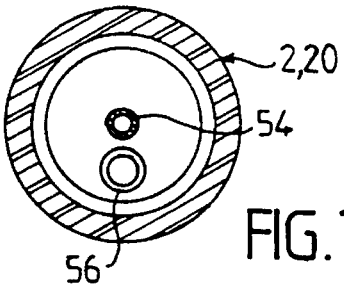

Also, the tool holder 30 may have various configurations; these are represented diagrammatically in FIGS. 6 and 7A to 7C which are transverse sections through the tool holder 30. In FIG. 6, we can recognize the configuration corresponding to the variant of FIG. 5 which includes a "vapour" line 54 and an "air" line 55; according to FIG. 7A, the tool holder 30 includes just the "vapour" line 54; according to FIG. 7B it includes 10 a "vapour" line 54, an "air" line 55 and a "fluid" line 56; according to FIG. 7C, it additionally includes, relative to the configuration corresponding to FIG. 7B, a thermophor element 57; according to the configuration of FIG. 7D, it includes just a "vapour" line 54 and a "fluid" line 56.

Figure 8:
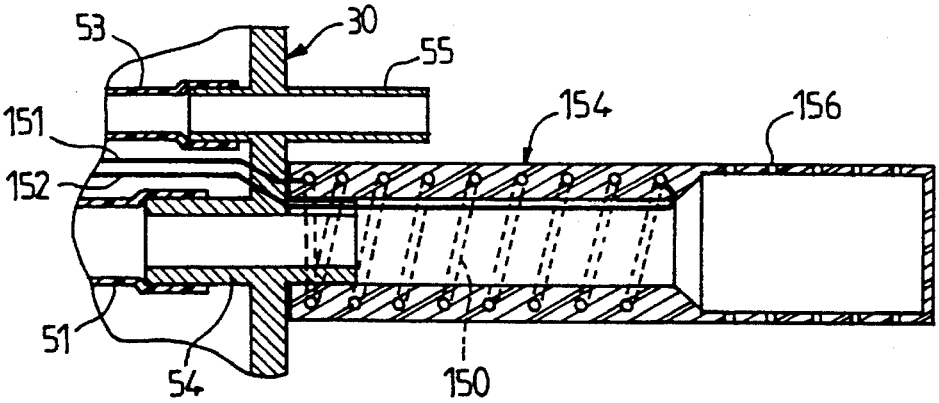
FIG. 8 is a partial view in section showing a tool holder equipped with a heat-generating thermophor element.

When the thermophor element 57 (FIG. 7C) is itself a heat generator, it is advantageous to produce it as a "vapour" line, this making it possible to avoid the phenomenon of condensation by thus superheating the vapour; such an arrangement is shown in FIG. 8; in this figure, the tool holder 30 includes a "vapour" line 54 which is reduced to a short pipe for connecting onto the pipe 51 and surrounded by a sleeve 154, a longitudinal portion of which includes an electrical resistor 150 incorporated into the wall and supplied via electrical conductors 151, 152; the end of the sleeve 154 which extends beyond the tool holder 30 is closed and its wall is thin and equipped with orifices 156 for the radial distribution of the vapour.

Figure 9:
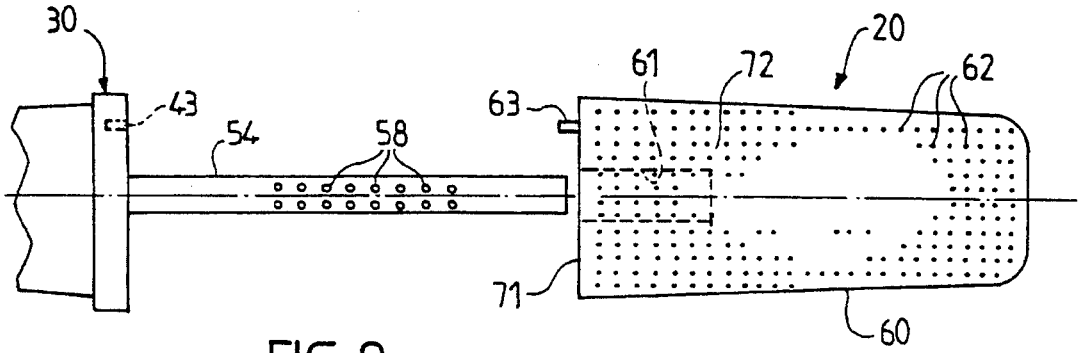
FIG. 9 is a view from above showing a tool for the treatment of hair.

Various tools may be provided for styling or treating hair. For treating hair, the tool 20 may be of the sort represented in FIG. 9; it consists of a hollow body 60 of flat and elongate overall shape, for example of eliptical cross-section decreasing towards its closed end opposite the one via which it is mounted on the tool holder 30, and the transverse wall 71 of which has a dog 63 interacting with an orifice 43 formed on the transverse edge of the tool holder 30; from the edge of an opening made in the wall 71 of the tool 20 there extends a guide sleeve 61 which is slipped around the "vapour" line 54 of the tool holder 30 when the tool 20 is mounted on the tool holder 30; the dog 63 allows the tool 20 to be positioned correctly and prevents it from turning. The body 60 of the tool 20 consists of a material of slight thickness, light weight and with an extremely low coefficient of thermal conduction to avoid the phenomenon of condensation during operation; the working face 72 of the tool 20 is equipped with fine perforations 62 in the form of holes or slits, such a working face 72 allowing good diffusion of the vapour. The hair is treated by the tool which has just been described by applying the working face 72 against a lock of hair arranged as a thin layer, close to its roots; then, by acting on the switch 43 of the tool holder 30, vapour is injected into the tool 20 through the "vapour" line 54 and its radial passages 58, then diffused through the perforations 62, while the tool 20 is displaced slowly along the lock towards the end of the hair which has or has not been impregnated with an appropriate product beforehand.

Figure 10:
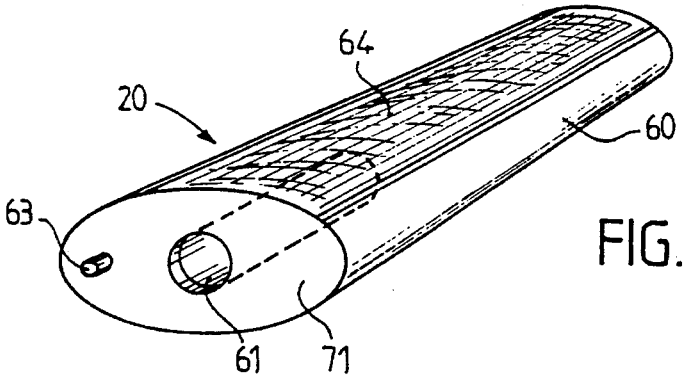
FIG. 10 is a view in perspective of a variant of a tool for the treatment of hair.

The diffusion of vapour may be achieved in some way other than via perforations 62 provided on the working face 72 of the tool 20; for example, as shown in FIG. 10, the tool 20 may be equipped with a diffuser 64 consisting of a fabric, a felt, an open-cell foam, a sintered material, or some other similar substance; the fabric may be cotton, velour, a brushed fabric or a carded fabric stretched over a frame mounted so that it can slide in grooves provided along a wide opening made at the surface of the tool 20, such an arrangement allowing the diffuser to be replaced; of course, the latter may equally well be provided so that it is stationary relative to the tool 20.

Figure 11:
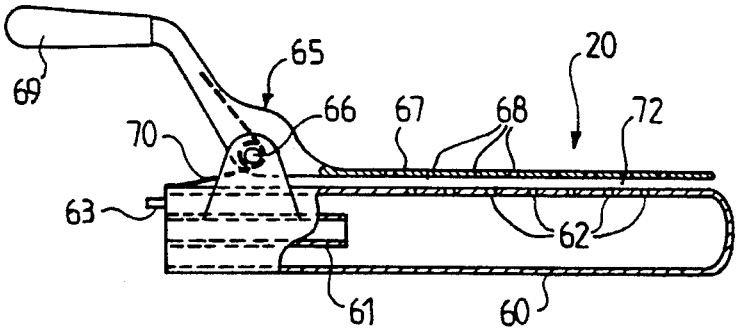
FIG. 11 is a view in partial section of a variant of a tool for the treatment of hair.
Figure 12:
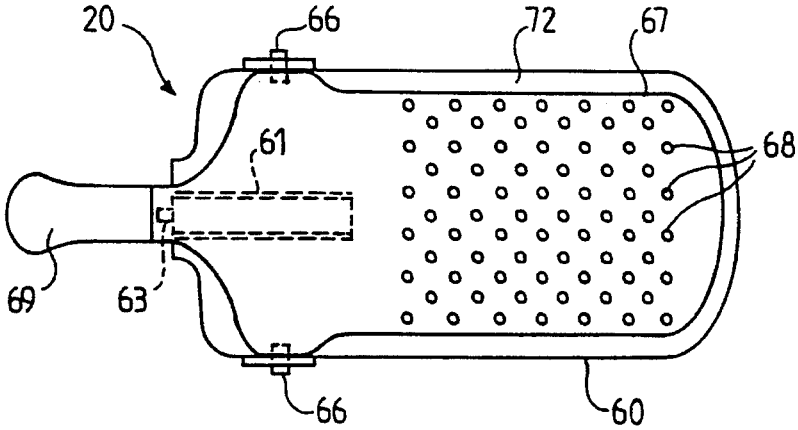
FIG. 12 is a view from above relative to FIG. 11.

With the objective of facilitating treatment or making it more effective, it may be useful to hold the hair using a tool 20 of the tongs type during treatment, therefore during the displacement of the tool along the hair from the root to the ends such a tool is shown in FIGS. 11 and 12; in these figures, it can be seen that the tool 20, in the vicinity of its end via which it is mounted on the tool holder 30, laterally has two half spindles 66 about which there is articulated a lever 65 consisting of a plate 67 covering the working surface 72 of the tool 20 whose shape it matches, and of a handle 69 for moving the plate 67 away from the surface 72 for the purpose of inserting the lock of hair between the plate 67 and the surface 72, which are urged towards one another by a hairpin-shaped spring 70; in FIG. 11, the plate 67 and the surface 72 have been represented distant from one another, even though the hair which they trap has not been represented, for the purpose of facilitating the understanding of the drawing; the plate 67 includes passages 68 so that the vapour which has passed through the lock of hair can escape.

Figure 13:
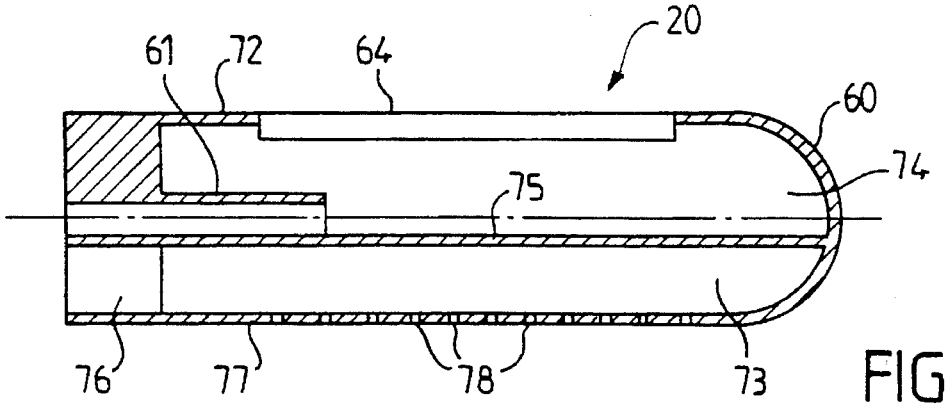
FIG. 13 is a view in section of a double-function tool with two working faces.
Figure 14:
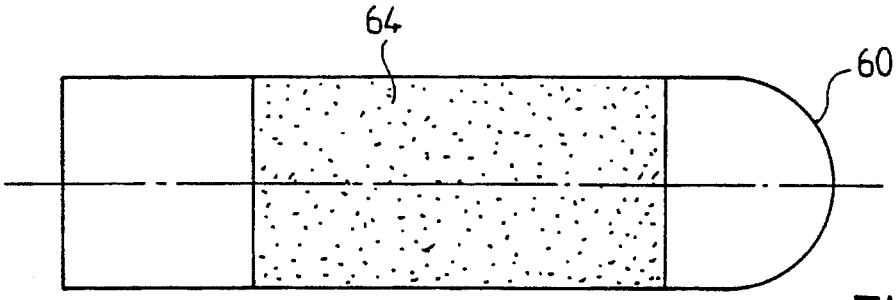
FIG. 14 is a view from above relative to FIG. 13.
Figure 15:
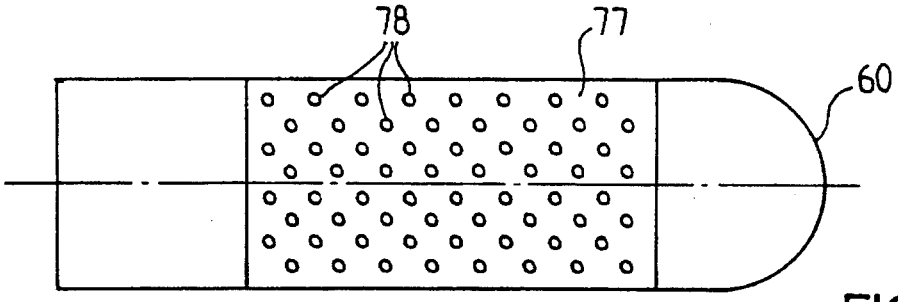
FIG. 15 is a view from below relative to FIG. 13.

The treatment tools which have just been described have just one working face 72; the face opposite the working face 72 and the tool 20 may equally well be arranged so that this opposite face also constitutes a working face; it is advantageous in this case to endow the tool with two treatment functions; the body 60 of the double-function tool 20 represented in FIGS. 13 to 15 is divided into two cells 73, 74 by a partition 75 parallel to the working face 72 and situated approximately half way up the body 60; the sleeve 61, intended to be engaged around the "vapour" line 54 of the tool holder 30 is placed in the cell 74, termed "vapour" cell, the working face 72 being equipped with a vapour diffuser 64; the cell 73 communicates with the outside, on the one hand, through wide orifices 78 which pass through the working face 77, opposite the working face 72 and, on the other hand, via a sleeve 76 emerging at the end face for mounting on the tool holder 30 and intended to interact with the "fluid" line 56 of the tool holder 30; it will have been noted that the interaction of the sleeves 61 and 76 of the tool 20 with the lines 54 and 56 of the tool holder 30, which have different diameters, allows the tool to be positioned; for example, the fluid passing through the sleeve 76 when the tool 20 is mounted on the tool holder 30 is hot air provided by the generator 10. Such a double-function tool is used as follows; first, the double-function tool 20 is applied against the lock of hair in the form of a thin layer, on the underside of this lock, via its working face 72 and displaced from the root towards the end of the hair while vapour is sent into the cell 74; this operation may be performed once or more; secondly, with the vapour supply cut off, the tool 20 is applied against the lock of hair, on the top side of this lock, via its working face 77, and displaced from the root to the end of the hair while hot air is pulsed into the cell 73; this operation allows the hair to be dried and allows a certain amount of styling.

According to a variant which has not been represented, the double-function tool 20, as has just been described, may be in the form of tongs, like the tool described with regard to FIGS. 11 and 12.

The double-function tool which has just been described fulfills two non-simultaneous functions and has two working faces, each being designed for one function; it is possible that it might be necessary to fulfill two functions simultaneously, for example by making two gaseous fluids act simultaneously; in this case, the double-function tool has just one working face but one which has consequently been adapted.

Figure 16:
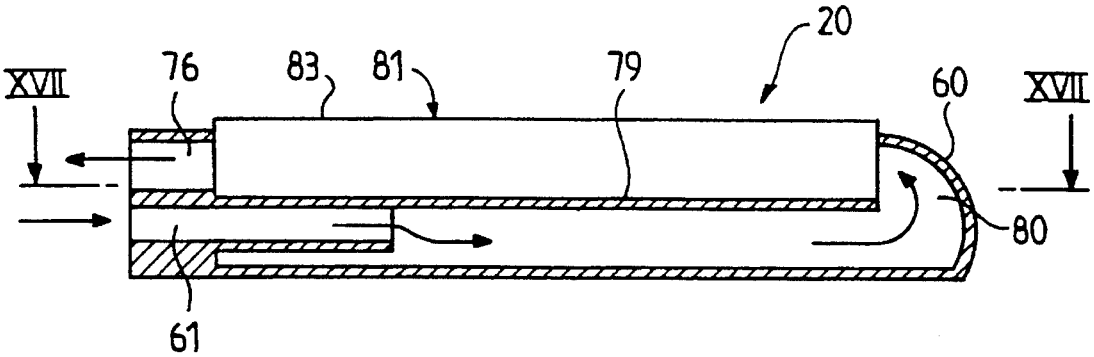
FIG. 16 is a view in section of a double-function tool with one working face.
Figure 17:
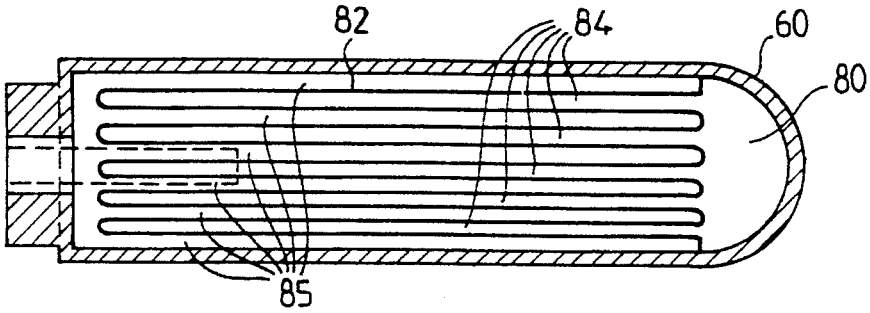
FIG. 17 is a view in section on XVII—XVII of FIG. 16.
Figure 18:
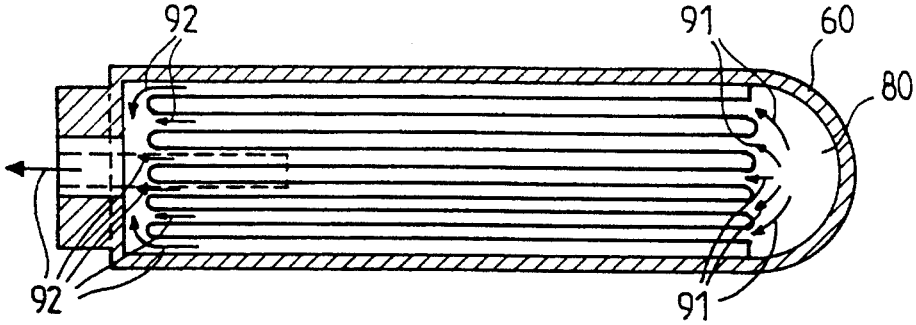
FIG. 18 is similar to FIG. 17 showing the direction of circulation of the fluids.
Figure 19:
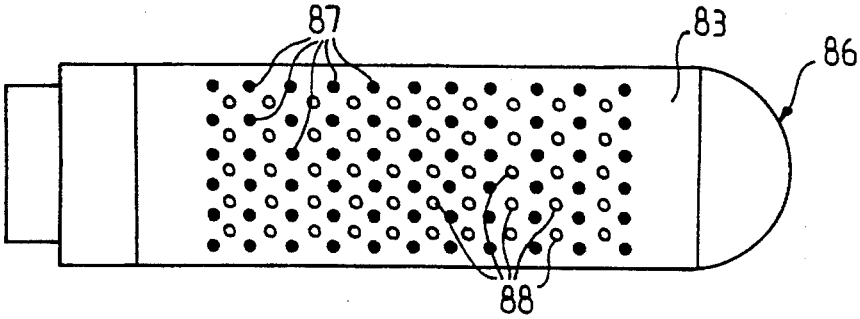
FIG. 19 is a view from above relative to FIG. 16.
Figure 22:
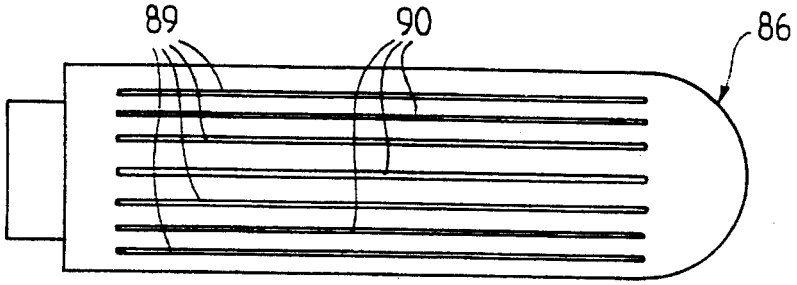
FIG. 22 is similar to FIG. 21 but represents a variant.

Referring to FIGS. 16 to 19, it can be seen that a double-function tool of this type includes a body 60 with a hairpin-shaped cross-section, a longitudinal partition 79 dividing the body 60 into two cells which communicate via a transverse passage 80 placed at the end of the tool 20; each of the cells is equipped with a sleeve to interact with one line in the tool holder; in the example represented, the lower cell, according to FIG. 16, includes the sleeve 61 intended to interact with the "vapour" line of the tool holder; the upper cell includes a sleeve 76 intended to interact with the "fluid" line of the tool holder; here, the "fluid" line is an air suction line; in the upper cell a flow splitter 81 has a sinusoidal partition 82 (FIG. 17) which defines longitudinal pipes communicating, alternately, with the passage 80 and with the sleeve 76; the upper face 83 of the flow splitter 81 is the working face of the double-function tool 20; the longitudinal pipes 84 which communicate with the sleeve 61, and the longitudinal pipes 85 which communicate with the sleeve 76 are grooves which are open at the top and are covered by a flow splitter mesh 86 represented in FIG. 19, the upper face of which constitutes the working face 83 of the tool; the flow splitter mesh 86 includes rows of holes arranged longitudinally; holes 87 represented as shaded in FIG. 19, which are suction holes, placed in line with the pipes 85, and holes 88 which are "vapour" holes placed in line with the pipes 84; of course, the flow-splitter mesh 86 may be produced in some other way; it being possible for the alternating rows of holes 87, and 88 for example to be replaced by alternating longitudinal slits 89, 90 as is shown in FIG. 22.

A double-function tool of this sort according to the example which has just been described, has the following advantage: while the vapour is treating the lock of hair after having been distributed in the direction of the arrows 91 in FIG. 18, the excess is taken up by suction in the direction of the arrows 92 of this same FIG. 18; this confers a certain amount of safety on the treatment, preventing the scalp from being burnt by excess vapour, and possibly makes it possible to absorb odours which could be released during the treatment of the lock of hair.

Figure 20:
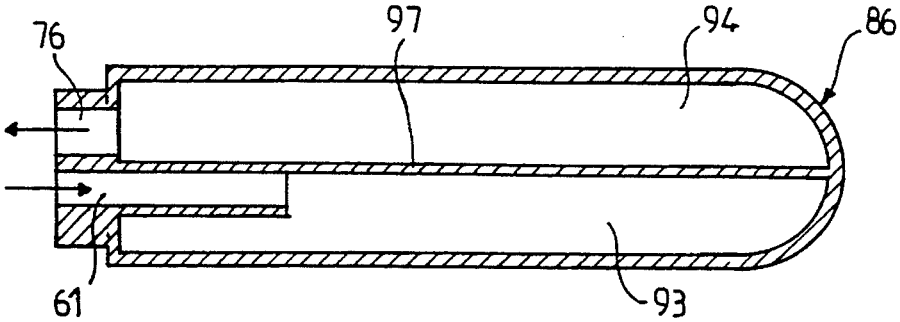
FIG. 20 is a view in section of a variant of a double-function tool with one working face.
Figure 21:
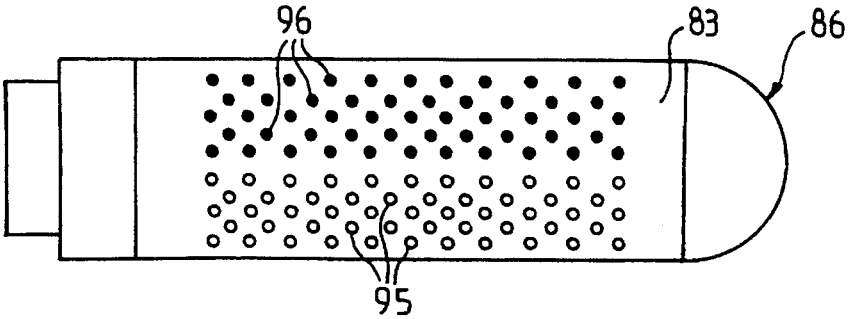
FIG. 21 is a view from above relative to FIG. 20.

As a variant, the double-function tool may include a body 60 divided into two cells 93, 94 separated by a partition 97 which, as FIG. 20 shows, is arranged at ninety degrees relative to the partition 79 of the double-function tool of FIGS. 16 to 19; the "vapour" sleeve 61 emerges in the cell 93 and the "air" sleeve 76 emerges in the cell 94; according to this variant, the flow splitter mesh 86 comprises rows of holes 95, 96 which do not alternate, the holes 95 being intended for distributing vapour and the holes 96 being intended for sucking in air; such a tool is displaced along the lock of hair from the root to the end such that the hair is firstly subjected to the vapour then treated with the air sucked in, which in particular allows it to be cooled.

Figure 23:
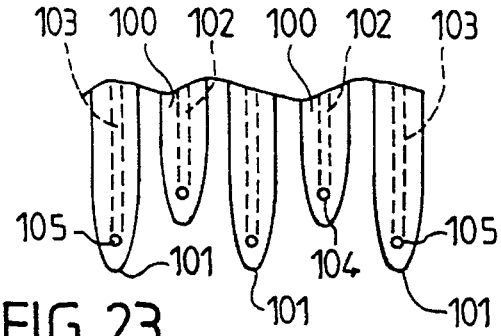
FIG. 23 partially shows, in elevation, distribution teeth.
Figure 24A:
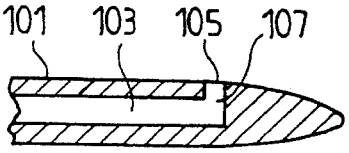
FIG. 24A shows in section one of the teeth of FIG. 23.
Figure 24B:
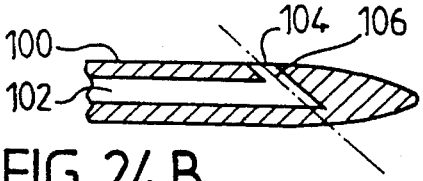
FIG. 24B shows in section a variant of teeth of FIG. 23.

The flow splitter mesh 86 described hereinabove which covers the longitudinal pipes 84, 85 or the cells 93, 94 like a cover for the body 60, may be equipped with teeth like a comb or a brush. The teeth may be solid and arranged between the holes 87, 88 or 95, 96; some teeth may have distribution holes close to their end in communication with passages which they have and themselves communicating with the longitudinal pipes 84, 85 or with the cells 93, 94; all the distribution holes may be carried by teeth. According to FIG. 23, teeth 100 have "vapour" passages 102 passing through them and emerging laterally in "vapour" holes 104; teeth 101 have "suction" passages 103 passing through them and emerging laterally in "suction" holes 105; the holes 105 emerge radially as FIG. 24A shows, the passage 103 ending in a length 107 bent at ninety degrees; the "vapour" holes 104 may emerge in the same way, radially; it is preferable for the "vapour" passages 102 to end in a length 106 visible in FIG. 24B, which is inclined so that it directs the jet of vapour away from the scalp with which the end of the tooth 100 may closely interact, for reasons of safety; this safety is equally well obtained by providing teeth of various lengths, as FIG. 23 shows; in this figure, the "suction" teeth 101 are longer than the "vapour" teeth 100, only the teeth 101 being brought into interaction with the scalp.

Figure 25:
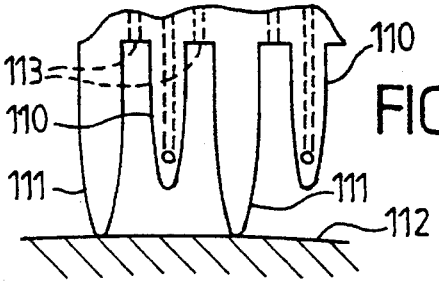
FIG. 25 is similar to FIG. 23 but represents a variant.
Figure 26:
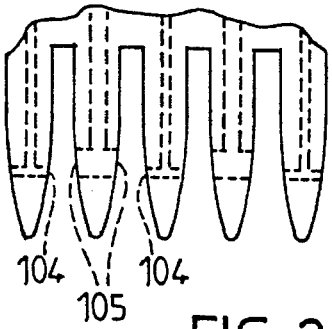
FIG. 26 is similar to FIG. 23 but represents another variant.

According to the variant of FIG. 25, the tool has "vapour" teeth 110 and solid protective teeth 111 without an orifice which are longer than the teeth 110 and designed to interact with the scalp 112; the suction orifices 113 emerge between the teeth, close to their root. When the teeth are all the same length, the safety talked of hereinabove may be obtained in the way illustrated in FIG. 26; the "vapour" orifices 104 and "suction" orifices 105 emerge radially at equal distances from the end of the teeth; this arrangement limits the rise in temperature of the scalp and allows immediate sucking away of residual vapour; according to this FIG. 26, each tooth has two orifices which are arranged radially in an opposed manner on either side of each tooth. Of course, regardless of the variant of toothed tool, these teeth may have one or more orifices arranged in any manner whatsoever, or aligned longitudinally; in this case, a row of orifices may be replaced by a longitudinal narrow slit.

Figure 27:
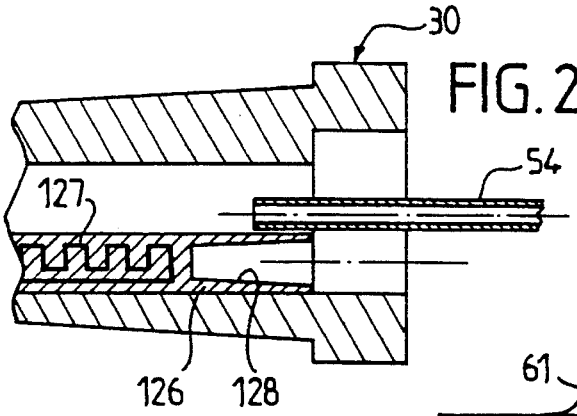
FIG. 27 shows partially, in section, a tool holder equipped with heating means.
Figure 28:
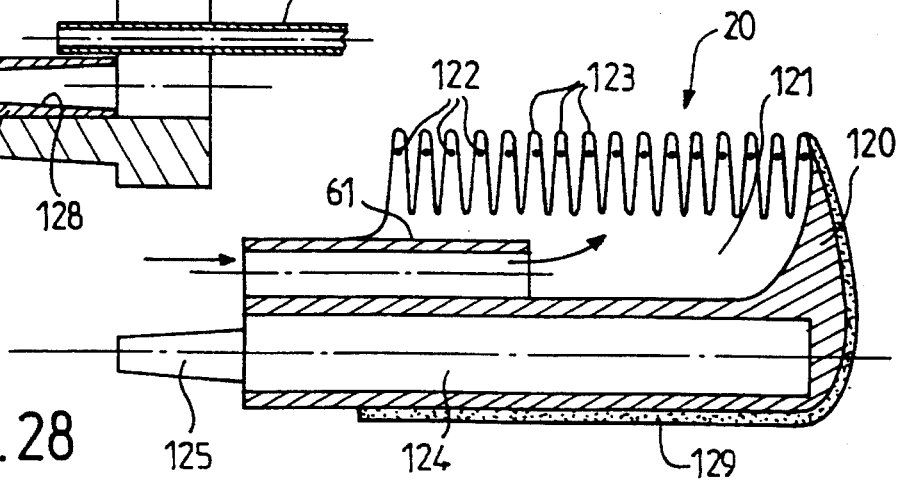
FIG. 28 shows in section a tool in the form of a comb intended to interact with the tool holder of FIG. 27.

To facilitate some types of hair styling it may be of benefit to have use of a comb whose teeth are heated to combine their action with that of the current of vapour; such a tool is shown in FIGS. 27 and 28; the tool 20 consists of a metal body 120, for example made of aluminum, defining a cell 121 into which there extends the sleeve 61 intended to receive the "vapour" line 54 of the tool holder 30; the cell 121 is in communication with the outside via orifices 122 provided close to the end of the teeth 123; the body 120 also includes a highly thermally conductive mass consisting, for example, of a rod of copper 124 held in the body 120 by overmoulding; the end 125 of the rod 124 extends beyond the outside of the body 120 and is of frustoconical shape; the tool holder 30 is equipped with a heating element 126 heated electrically by an electrical resistor 127 and including a housing 128, also of frustoconical shape, intended to receive the end 125 of the rod 124; thus, when such a tool 20 is mounted on such a tool holder 30, and when the resistor 127 is supplied electrically, the rod 124 is heated up and transmits its heat to the metal body 120; the teeth 123 are heated by conduction; of course, through a safety measure for the user, the outside surface of the body 120 is thermally insulated by an insulating jacket 129 applied directly against the body 120 or some distance from the latter so that a film of insulating air is formed between the body 120 and the jacket 129.

Figure 29:
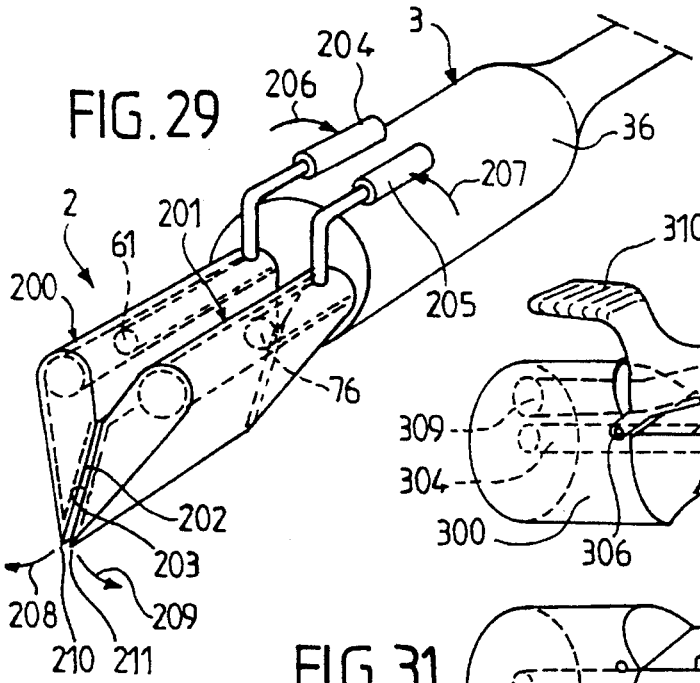
FIG. 29 is a diagrammatic view in perspective of a double-function tool in the form of tongs.

When the tool is of the double-function type, it may be advantageous for the two functions to be used simultaneously on either side of the lock of hair; such a tool is represented in FIG. 29; in this figure, the tool 2 consists of two elements 200, 201 mounted so that they can turn on the tool holder 3; each of the said elements includes one working face, the element 200 including the working face 202, and the element 201 including the working face 203. The element 200 is mounted so that it can turn around the "vapour" line 61 of the tool holder 3, while the element 201 is mounted so that it can turn around the "suction" line 76 of the tool holder 3. Each of the elements 200, 201 has a cross-section of triangular overall shape and they are arranged so that in the position of rest towards which they are urged by elastic means which have not been represented, the working faces 202, 203 are in contact with one another, their longitudinal end edge, respectively 210 and 211 then also being in close contact with one another. To facilitate the use of such a tool, each of the elements 200, 201 has an operating lever, respectively 204 and 205, extending parallel to the grip 36 for holding the tool holder 3; by exerting a force bringing the two levers 204 and 205 closer together, as is illustrated by the arrows 206 and 207, the working faces 202 and 203 move apart as is illustrated by the arrows 208, 209, thus allowing a lock of hair to be treated to be inserted between them; by releasing the force on the levers 204 and 205 the lock of hair is pinched between the working faces 202 and 203; it is then sufficient to displace the tool along the lock of hair from the root towards the end while vapour is distributed through the working face 202 and the lock of hair, the vapour being taken back up by the working face 203 connected to the "suction" line 76; it should be noted that such an arrangement makes it possible to get closer to the scalp with complete safety, the vapour being taken back up immediately by the "suction" line 76 after it has passed through the lock of hair.

Figure 30:
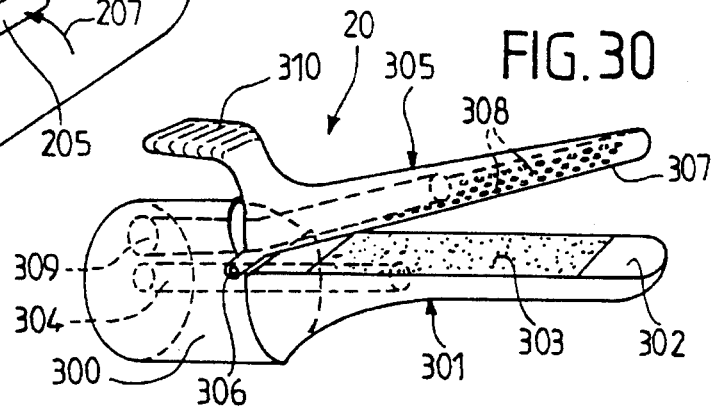
FIG. 30 is a view in perspective diagrammatically representing a variant of a double-function tool in the form of tongs.

The hinge pin of the two elements 200, 201 having the working faces 202, 203 of the tool 2 of FIG. 29 is axial, that is to say in the extension of the axis of the grip 36 of the tool holder 3; such a hinge pin could be transverse, that is to say in a direction practically perpendicular to the axis of the grip of the tool holder; such a tool 20 is represented in FIG. 30 and includes a body 300 extended into a hollow stationary jaw 301 having the flat working face 302 covered with holes 303 in communication with the "vapour" sleeve 304. On the body 300 there is mounted a hollow jaw 305 articulated about a spindle 306 parallel to the working face 302; the articulated jaw 305 has a working face 307 which is also flat and intended to interact in contact with the stationary working face 302; the working face 307 is covered with holes 308 in communication with the "suction" sleeve 309; advantageously, the sleeve 309 consists of an elastic tube so that it can also act as elastic return means for the mobile jaw 305 which is thus constantly urged towards the position which it occupies when the two working faces 302, 307 are in contact with one another; a lever 310 allows the user to move the jaws 301, 305 apart in order to place the lock of hair to be treated therein.

Figure 31:
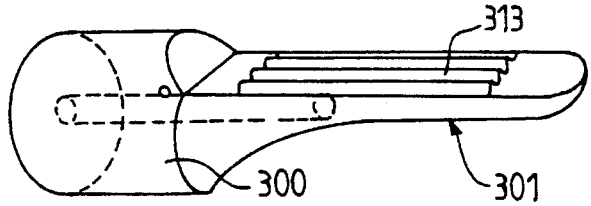
FIG. 31 is a view in perspective diagrammatically representing a variant of a jaw of a tool of the sort of FIG. 30.

In general, the working faces of the tools described up until now have a flat shape; it is possible to give the working faces any desirable shape depending on the hair treatment operation which is to be carried out; for example, as shown in FIG. 31, the treatment zone of the working face may have waves 313 arranged axially relative to the tool, that is to say transversely relative to the lock of hair to be treated; of course, the mobile jaw also has waves of shape complementary to that of the waves 313 of the stationary jaw, the waves of one jaw fitting into the waves of the other jaw.

Tongs such as the tool 20 of FIG. 30 may be used in the following sequential way: after having been trapped between the jaws equipped with waves, the lock of hair is subjected to a current of vapour and to a suction current of air simultaneously for a few seconds; then, the current of vapour is halted, and the lock is then subjected merely to the sucked current of air which cools it; the current of air is stopped, the tongs opened and the lock of hair released.

The treatment zone of the working faces of the tools has dimensions, and especially a length, which are determined by construction so that it can treat a wide thin layer of hair; now, it is not always possible to cover the zone over its entire length, bearing in mind the various widths of the thin layers of hair to be treated; so that the distribution of the treatment fluids is as homogeneous as possible, regardless of whether the treatment zone is completely or only partially covered with hair, the invention envisages adapting the head loss through the distribution holes to the fluid which is passing through them and especially to its pressure; thus, and as is visible in the figures, vapour being distributed under a high pressure, given the other fluids distributed, such as blown or sucked air, the "vapour" holes are smaller than the "suction" holes; good results have been obtained as regards homogeneity of the distribution of the vapour when the head loss across the "vapour" working face was greater than $0.05\times10^{-3}$ bar, for example equal to $0.1\times10^{-3}$ bar.

Figure 33:
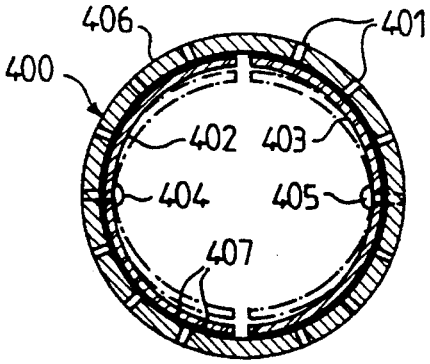
FIG. 33 is a view in section of a distribution line which can be used in both directions, the head losses corresponding to each of the two directions being different.

The diversity of the tools combined with the various possibilities of the generator may lead to one and the same line being used for different fluids; it is also possible to use one and the same line in one direction or in the other, for example by pushing high pressure vapour through it in one direction or sucking air through it in the other direction; in such a case, the invention envisages endowing such a line with different head losses depending on whether it is used in one direction or the other. One embodiment is shown in FIG. 33; the line 400 represented in section in this figure has a cylindrical wall 406 through which there pass radial orifices 401 distributed circumferentially; two semi-cylindrical walls 402, 403 internally line the cylindrical wall 406, covering over the orifices 401; the semi-cylindrical walls 402, 403 are made from a relatively elastic material and are fixed to the cylindrical wall at their middle, along a generatrix, as shown at 404, 405; the semi-cylindrical walls 402, 403 have holes 407 passing through them, with a smaller diameter than that of the orifices 401. As a consequence, when a pressurized fluid is brought inside the line 400, this pressurized fluid presses the semi-cylindrical walls 402, 403 against the internal surface of the cylindrical wall 406 and leaves radially from the line 400, passing through the holes 407, of small diameter, then the orifices 401 of larger diameter; if, in contrast, the inside of the line 400 is connected to a suction source, air is sucked into the line 400 from outside through the orifices 401 of large diameter and between the cylindrical wall 406 and the semi-cylindrical walls 402, 403 which have flexed about their generatrix by which they are fixed and along which are arranged the fastening means 404, 405, as shown in chain line in FIG. 33, owing to the partial vacuum prevailing inside the line 400.

The assembly according to the invention may equally well include a device for filtering the fluids conveyed making it possible to absorb odours, excess products used when operating on hair, reaction by-products, or to condense some vapours preventing them thus from condensing in the premises where the hair is being operated on, especially on the window panes.

It has been seen that, as air can be conveyed through the tool in one direction or the other, that is to say blown into the tool or sucked through the tool, it is of course possible to choose a reversible turbine and the change in direction of rotation of the motor which drives it makes it possible to obtain the "blown" or "sucked" direction for the air. This air may be heated; the means for heating the air are either in the casing of the generator, or in the tool holder.

One and the same distribution line may equally well be followed in the same direction by two different fluids; for example, since hot air and vapour are rarely used simultaneously for one and the same tool, the assembly may be arranged so that the vapour and the air can follow one and the same distribution line when one of the fluids—hot air or vapour—is used.

It will easily be understood that when additional products are necessary for certain treatments for the hair, these additional products may be added to one of the fluids used, in the solid, liquid or vapour state, from the generator, the tool holder or the tool.

It has also been seen, earlier, that operating on hair could be carried out according to certain sequences which could be chosen manually from push buttons carried by the casing; as certain sequences are specific to certain specific treatment tools, it is possible, when these tools are mounted on the tool holder in such a way that they can be removed, to provide contact means on the tool holder and on the tool which, when the tool is in place, automatically indicate to the microprocessor for managing the assembly according to the invention, the sequence to be undertaken for operating on hair using that particular tool.

We claim:

1. Assembly intended for operating on hair, comprising: a generator; a tool holder equipped with a grip for holding; and a tool adapted to be coupled to said tool holder; said generator and said tool holder being arranged to provide the tool with at least one vapour supply, said generator and said tool holder being independent from one another and being connected by a flexible tubing including at least one pipe for supplying the tool holder with vapour, said tool holder including a vapour-outlet line having a wall with vapour distribution orifices thereon, said vapour-outlet line extending away from said tool holder such that upon coupling the tool to the tool holder, the vapour-outlet line extends into said tool.

2. Assembly according to claim 1, wherein the generator is housed in a casing configured as a trailing device which can be placed on the ground.

3. Assembly according to claim 1, wherein the vapour is selected from the group consisting of water vapour and alcohol vapour.

4. Assembly according to claim 1, wherein the generator includes means for conveying other fluids through the tool.

5. Assembly according to claim 4, wherein the generator includes means for heating said other fluids.

6. Assembly according to claim 4, wherein said other fluids are blown and/or sucked through the tool.

7. Assembly according to claim 1, wherein the tool holder includes a line for conveying air through the tool.

8. Assembly according to claim 7, wherein the line for conveying air through the tool is connected to a suction side of a suction turbine mounted in the tool holder.

9. Assembly according to claim 1, wherein the tool holder has a thermophore element.

10. Assembly according to claim 1, wherein the tool holder includes a line for conveying another fluid through the tool.

11. Assembly according to claim 1, wherein the tool holder includes an electrical heating resistor.

12. Assembly according to claim 1, wherein the tool is equipped with a diffuser.

13. Assembly according to claim 12, wherein the diffuser is arranged such that the vapour is distributed homogeneously regardless of the extent to which a lock of hair being treated covers the diffuser.

14. Assembly according to claim 1, wherein the tool is in the general shape of tongs and includes a lever comprising a plate covering a working surface of the tool, said plate including passages for the vapour.

15. Assembly according to claim 4, wherein the tool is a double-function tool and includes two working faces.

16. Assembly according to claim 4, wherein the tool is a double-function tool and includes just one working face.

17. Assembly according to claim 4, wherein the tool has a working face, which is one of flat, cylindrical, and conical.

18. Assembly according to claim 4, wherein the tool has a working face configured as one of a brush and a comb.

19. Assembly according to claim 1, wherein the tool includes a thermally conductive mass.

20. Assembly according to claim 19, wherein the tool holder includes a heating element for heating the thermally conductive mass.

21. Assembly according to claim 4, wherein the tool is a double-function tool and has the shape of tongs including two jaws, each of said jaws having a working face.

22. Assembly according to claim 1, wherein the tool is secured, and stationary relative, to the tool holder.

23. Assembly according to claim 1, wherein the tool is secured, and rotatably mounted, to the tool holder.

24. Assembly according to claim 1, wherein the tool is removably mounted on the tool holder.

* * * * *